United States Patent [19]

Schmohl

[11] 4,342,161

[45] Aug. 3, 1982

[54] LOW SPORT SHOE

[75] Inventor: Michael W. Schmohl, Willibaldstr. 30A, D-8500 Nuremberg, Fed. Rep. of Germany

[73] Assignee: Michael W. Schmohl, Aachen, Fed. Rep. of Germany

[21] Appl. No.: 241,814

[22] Filed: Mar. 9, 1981

Related U.S. Application Data

[63] Continuation of Ser. No. 962,459, Nov. 20, 1978, abandoned.

[30] Foreign Application Priority Data

Nov. 23, 1977 [DE] Fed. Rep. of Germany ..... 2752301

[51] Int. Cl.[3] ..... A43B 5/00; A43B 11/00

[52] U.S. Cl. ..... 36/114; 36/50; 36/58.5; 36/128

[58] Field of Search ..... 36/114, 113, 50, 58.5, 36/99, 128, 129, 45

[56] References Cited

U.S. PATENT DOCUMENTS

| | | | |
|---|---|---|---|
| 1,258,629 | 3/1918 | Bliss | 36/45 |
| 1,986,580 | 1/1935 | Johnson | 36/99 X |
| 2,113,507 | 4/1938 | Drell | 36/50 |
| 3,768,182 | 10/1973 | Powers | 36/114 |

FOREIGN PATENT DOCUMENTS

| | | | |
|---|---|---|---|
| 827910 | 1/1952 | Fed. Rep. of Germany | 36/114 |
| 22062 | of 1909 | United Kingdom | 36/128 |
| 176180 | 3/1922 | United Kingdom | 36/128 |
| 207426 | 11/1923 | United Kingdom | 36/128 |
| 278850 | 10/1927 | United Kingdom . | |
| 363008 | 12/1931 | United Kingdom . | |
| 379872 | 9/1932 | United Kingdom . | |
| 1422219 | 1/1976 | United Kingdom . | |

OTHER PUBLICATIONS

ABC Schuh Fabrication, Dec. 15, 1933, p. 2250.

*Primary Examiner*—James Kee Chi
*Attorney, Agent, or Firm*—Charles A. Blank

[57] ABSTRACT

A shoe having a sole, an upper formed from a relatively soft and extensible material, a lacing strip and a bandage connecting the lacing strip with the sole. The bandage is formed from a material which is less extensible than the material of the upper. The bandage includes an elongated portion and a connecting portion which extends laterally of the elongated portion at the juncture of the bandage with the lacing strip. The laterally-extensive connecting portion transmits forces from the lacing strip to the elongated portion, and substantially prevents transmission of such forces through the extensible material of the upper. Thus, the upper is less apt to become fatigued or distorted during wear. This abstract should not be taken as a complete exposition of the present invention.

6 Claims, 2 Drawing Figures

LOW SPORT SHOE

This is a continuation of application Ser. No. 962,459, filed Nov. 20, 1978, now abandoned.

BACKGROUND OF THE INVENTION

This invention relates to footwear, and relates in particular to sport shoes.

Sport shoes, such as jogging shoes, tennis shoes and the like, normally include uppers which are formed from relatively soft and extensible material such as thin fabric or thin, soft leather. An upper formed from such a soft material conforms closely to the contour of the foot without subjecting any particular area of the foot to excessive pressure. However, the soft material of such an upper is limited in its capacity to accurately and dependably transmit forces from the foot to the sole of the shoe. Also, such a soft upper is subject to distortion due to the forces applied to it by the laces of the shoe.

It has long been known in the art to provide socalled "lacing strips" and "bandages". The "lacing strips" are strips of relatively inextensible material arranged on either side of the tongue slot of the shoe and provided with holes to receive the laces. These lacing strips run generally forwardly and downwardly over the area of the shoe which overlies the instep of the foot.

The "bandages" are relatively thin, strap-like elongated elements formed from a relatively inextensible material such as a relatively thick, tough leather. Each such bandage extends generally rearwardly and downwardly from a lacing strip along a side of the upper to a rearward portion of the sole of the shoe. The bandages transmit the forces from the lacing strips to the sole of the shoe. Thus, forces exerted by the laces can be transmitted to the sole without relying on the relatively extensible material of the upper. Furthermore, forces applied by the foot to the area of the upper overlying the instep can also be transmitted along the bandages to the sole of the shoe, again without relying on the relatively extensible material of the upper.

However, this arrangement of lacing strips and bandages does not provide a complete solution to the problem of transmitting forces to the sole of a shoe having an upper formed from a relatively extensible material. The bandages described above are relatively narrow, and are joined to each lacing strip over only a small portion of the length of that lacing strip. Thus, certain areas of the lacing strips (for example the extreme forward ends of the lacing strips) will be remote from the junctures of the lacing strips with the bandages. The relatively extensible material of the upper may still be subjected to forces transmitted from these portions of the lacing strips. Thus, the material from the upper adjacent to the forwardmost ends of the lacing strips is often found to fatigue or stretch during the life of the shoe. When this occurs, the upper will no longer closely conform to the contour of the foot.

Further, the forces transmitted through the bandages are all concentrated at the relatively narrow junctures between the bandages and the lacing strips. Therefore, the areas of the instep which these junctures overly will be subjected to concentrated loadings with resultant discomfort to the wearer.

Accordingly, it is the principal object of the present invention to provide a shoe which incorporates a relatively extensible upper and which can therefore closely and comfortably conform to the foot, but which is capable of accurately and dependably transmitting forces exerted by the laces and by the foot to the sole of the shoe without the disadvantages of the aforementioned bandage and lacing strip arrangement.

The shoe of the present invention includes an upper formed from a first material and a lacing strip affixed to the upper so that it extends generally forwardly and downwardly and generally rearwardly and upwardly on an area of the upper which is adapted to overlie the instep of a foot received in the shoe. The shoe is provided with a bandage which includes an elongated portion and a connecting portion, remote from the elongated portion, extends laterally of the elongated portion and is affixed to the lacing strip. The elongated portion of the bandage extends generally downwardly and rearwardly from the connecting portion of the bandage to a second end, which is affixed to a rearward portion of the sole. The bandage is formed from a second material which is substantially less extensible than said first material.

The connecting portion of the bandage is preferably affixed to the lacing strip over a substantial portion of the length of the lacing strip. Therefore, the connecting portion can transmit forces applied to this portion of the lacing strip to the elongated portion, which can transmit them to the sole. Thus, forces applied to the lacing strip in the shoe of the present invention are not concentrated at any narrow juncture between lacing strip and bandage, and are less apt to be transmitted through the relatively extensible material of the upper.

These and other objects, features, and advantages of the present invention will be more readily apparent in view of the following detailed description of the preferred embodiment, when read in conjunction with the accompanying drawing.

DETAILED DESCRIPTION OF THE PREFERRED EMBODIMENTS

Figure 1:
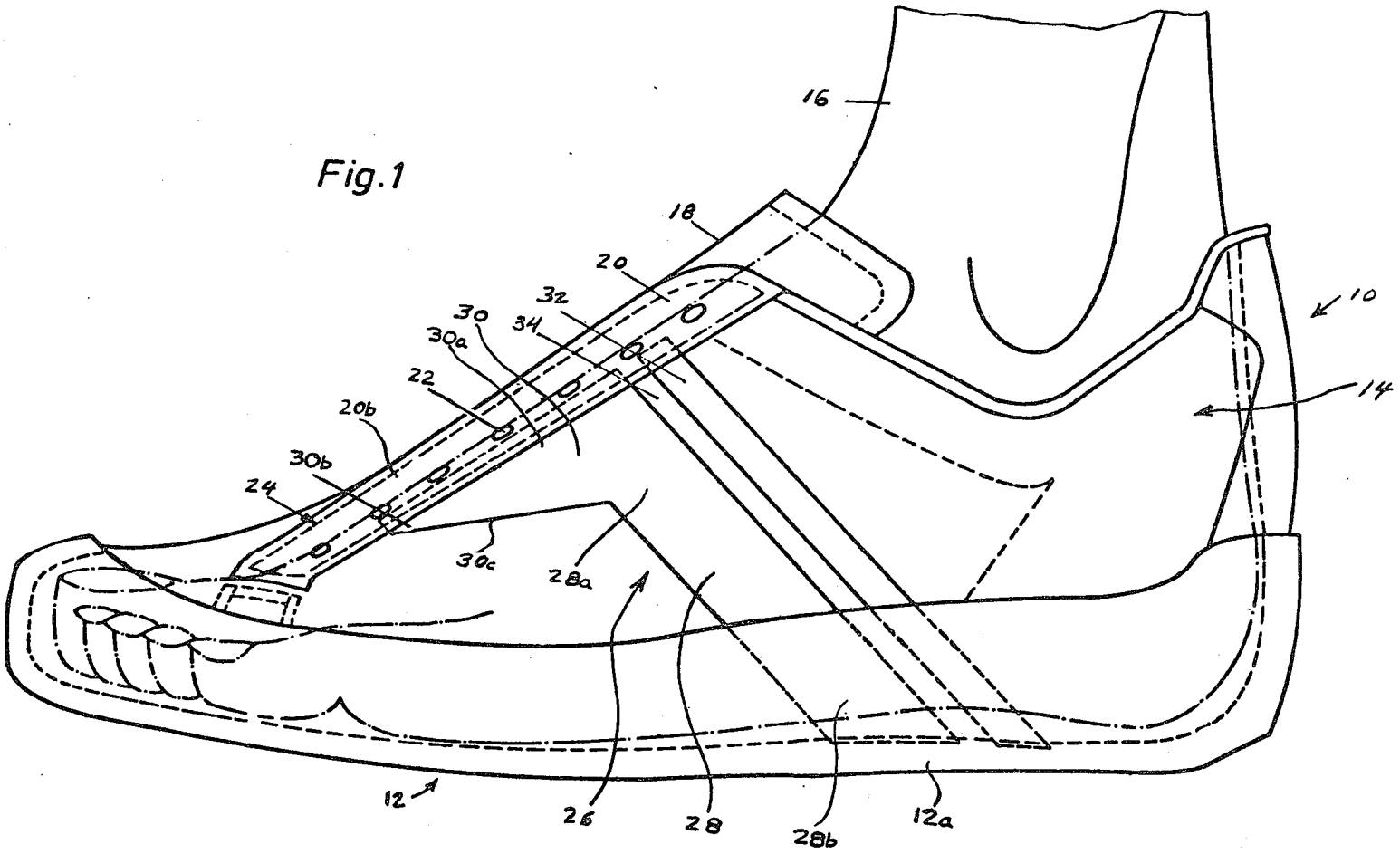
FIG. 1 is a side elevational view of a shoe according to a preferred embodiment of the present invention.

As shown in FIG. 1, a shoe 10 in accordance with a preferred embodiment of the present invention includes a sole 12 and an upper 14. The upper 14 is formed from a substantially extensible and comformable material such as soft leather or an unreinforced textile material. The upper is formed generally in the shape of a foot 16, so that the upper may receive the foot. In the conventional manner, the upper is provided with a tongue slot in the area adapted to overlie the instep of the foot, and a tongue 18 bridges this tongue slot. A lacing strip 20 extends generally forwardly and downwardly and generally rearwardly and upwardly along one side of the tongue slot, in an area of the upper which is adapted to overlie the instep of the foot 16. This lacing strip 20 is provided with holes 22 to receive the laces (not shown). The lacing strip 20 is affixed to the remainder of the upper by stitches 24.

A bandage 26 connects the lacing strip 20 with a rearward portion 12*a* of the sole 12. The bandage 26 includes an elongated portion 28 and a connecting portion 30.

A first edge 30*a* of the connecting portion 30 is remote from the elongated portion 28. This first edge 30*a* of the connecting portion 30 is affixed to the lacing strip 20.

The length of this first edge 30*a*, along which the connecting portion is affixed to the lacing strip, encompasses a substantial portion of the length of the lacing strip. Preferably, this length of the first edge 30*a* is greater than the width of the elongated portion 28 of the bandage. The elongated portion 28 and the connecting portion 30 are formed integrally, so that a first end 28*a* of the elongated portion 28 of the bandage is affixed to the connecting portion 30 of the bandage at the juncture between the elongated portion and the connecting portion. The elongated portion 28 extends generally downwardly and rearwardly from its first end 28*a* to its second end 28*b*. This second end 28*b* is affixed to the rearward portion 12*a* of the sole.

The connecting portion 30 extends generally laterally of the elongated portion 28. In the embodiment shown, the connecting portion 30 extends generally forwardly of the elongated portion 28 so that the forwardmost tip 30*b* of the connecting portion 30 lies adjacent to the forwardmost end of lacing strip 20. A second edge 30*c* of the connecting portion 30 extends from the forwardmost tip 30*b* of the connecting portion to the juncture of the connecting portion with the elongated portion. This second edge 30*c* slopes away from the lacing strip 20 in the rearward direction (towards the juncture of the connecting portion with the elongated portion). Thus, the dimension of the connecting portion 30 in the direction of elongation of the elongated portion (the downward and rearward direction) is greater at the juncture of the connecting portion with the elongated portion than at the forwardmost tip 30*b*.

An auxiliary strap 32 also extends from the lacign strap 20 to the sole of the shoe. The auxiliary strap 32 is narrow and elongated, and its direction of elongation is generally parallel with the direction of elongation of the elongated portion 28 of bandage 26. The auxiliary strap 32 is positioned generally rearwardly of the bandage 26, so that the bandage 26 and the auxiliary strap 32 together define an area 34 on the surface of the upper 14.

The lacing strip 20, the bandage 26, and the auxiliary strap 32 are formed from a second material which has a greater resistance to elongation than the material from which the upper is formed. The relationship between the resistance to elongation of the bandage material and the resistance to elongation of the upper material is essential to the function of the bandage and of the auxiliary strap. However, any material can be used for the bandage so long as it is less extensible than the material of the upper. For example, the bandage may be fabricated from a metal, from a synthetic textile such as polyamide or aramide, or from woven glass. Most preferably, the bandage is fabricated from a relatively tough and hard rubber with embedded nylon fibers running generally in the direction of elongation of the elongated portion.

As can be appreciated, various forces are applied to the lacing strip. The laces themselves tend to pull the lacing strip towards the central axis of the shoe and thus tend to pull it up over the instep of the foot and away from the sole. Also, the foot within the shoe will bear on the lacing strip by way of the tongue and tend to force the lacing strip upwardly and away from the sole. These forces are distributed over the length of the lacing strip.

The elongated portion 28 of the bandage is relatively narrow. If the connecting portion 30 of the bandage were omitted, and the elongated portion 28 were simply extended so that its first end 28*a* were attached to the lacing strip 20, the lacing strip 20 would only be affixed to the bandage and to the auxiliary strap over a relatively small portion of the length of the lacing strip. Thus, the forces applied to the forward portion 20*b* of the lacing strip would not be transmitted to the bandage. These forces would be transmitted to the sole via the relatively extensible material of the upper.

However, because the connecting portion 30 extends laterally of the elongated portion 28, the connecting portion 30 can absorb the forces exerted on the forward portion 20*b* of the lacing strip and transmit these forces to the elongated portion 28 of the bandage. Therefore, the forces applied to the forward portion 20*b* of the lacing strip will be borne by the bandage and not by the material of the upper.

The forces applied to the rearwardmost portion of the lacing strip 20 will be transmitted to the sole via the auxiliary strap 32. However, the greater portion of the forces will be transmitted by way of the bandage 26. Therefore, the elongated portion 28 of the bandage 26 is made wider than the auxiliary strip 32.

The forward part of the connecting portion 30 which extends laterally of the elongated portion 28 may be considered akin to a cantilever beam. The forward portion 20*b* of the lacing strip applies a distributed load to this cantilever beam. The forces making up this distributed load are generally in the direction of elongation of elongation portion 28. To minimize the area occupied by the connecting portion, the dimension of the connecting portion in this direction of elongation varies. Thus, at the forwardmost tip 30*b*, this dimension is small because only a small load need be transmitted, while at the juncture of the elongated portion with the connecting portion 28, this dimension is large because a larger load must be transmitted.

Figure 2:
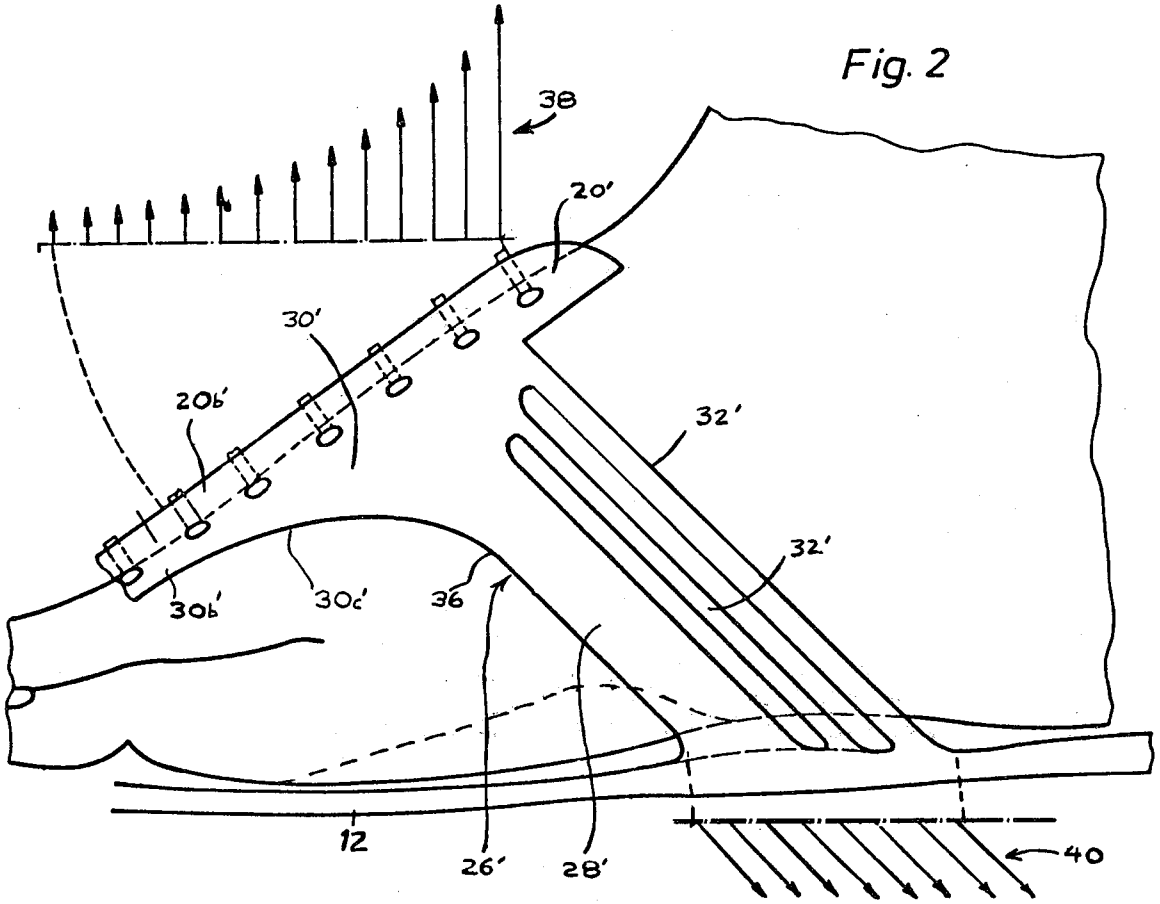
FIG. 2 is a schematic side elevational view showing the force transmissive elements of a shoe according to an alternate embodiment of the present invention.

An alternate embodiment of a shoe of the present invention is illustrated in FIG. 2. However, the upper and the tongue have been omitted from FIG. 2 for clarity of illustration. The lacing strip 20' and the bandage 26' of this embodiment are formed integrally with one another. This integral component also includes two auxiliary straps 32' which are joined to the bandage at the connecting portion 30' and at the juncture of the elongated portion 28' with the sole. The second edge 30*c'* of the connecting portion of this embodiment is curved rather than straight. This second edge 30*c'* extends from the forwardmost tip 30*b'* of the connecting portion 30' to the juncture between the connecting portion 30' and the elongated portion 28'. The second edge 30*c'* curves away from the lacing strip 20' in the area adjacent to the juncture of the connecting portion and the elongated portion. This second edge 30*c'* is tangential to the forward lateral edge 36 of the elongated portion 28' at the juncture of these two edges. The smooth blending of the second edge 30*c'* and the forward lateral edge 36 of the connecting portion 28' prevents the occurrence of any stress concentration at the juncture of these two edges.

This distribution of forces over the length of the lacing strip is illustrated by the arrows 38 at the top of FIG. 2. For clarity of illustration, these arrows have been rotated away from the actual direction of the forces. In fact, these forces shown by the arrows 38 are directed generally forwardly and upwardly.

As shown by the arrows 38, the forwardmost portion of the lacing strip 20*b'* and the adjacent tip 30*b'* of the connecting portion 30' are under only relatively small loads. The loads applied to the lacing strip and to the connecting portion are greater in the area adjacent to the juncture of the connecting portion 30' with the elongated portion 28'. The curved form of the second edge 30*c'* of the connecting portion 30' assures that, at any point along the lacing strip, the dimension of the connecting portion in the direction of the forces will be substantially proportioned to the load which the connecting portion must bear at that point. The arrows 40 illustrate the distribution of forces at the juncture of the elongated portion 28' and the auxiliary strap 32' with the sole of the shoe.

The elongated portions of the bandages in both of the embodiments described above are relatively narrow, and hence do not interfere with the extensibility of the upper over any substantial proportion of its area. However, because of the laterally extensive connecting portion, the forces applied to the lacing strips may be transmitted by way of these bandages and not by way of the relatively extensible material of the upper. Furthermore, this force transmission is accomplished without concentrating the loads at any point along the lengths of the lacing strips. Thus, the shoes of the embodiments described above are capable of wear without distortion of the upper due to forces transmitted through the extensible material thereof and without discomfort due to concentrated loadings on the lacing strips.

Numerous variations and combinations of the features described above may be made without departing from the spirit of the present invention. Merely be way of example, the auxiliary straps described above may be omitted if the connecting portion of the bandage extends to the rearward portion of the lacing strip. Therefore, the foregoing description of the preferred embodiments should be considered as merely illustrative of the present invention.

What is claimed is:

1. A low shoe comprising a low upper formed from a first material, a sole, a lacing strip affixed directly to said upper and extending generally forwardly and downwardly and generally rearwardly and upwardly on an area of said upper adapted to overlie the instep of a foot received in the shoe, and a bandage formed from a second material which is substantially less extensible than said first material, said bandage including an elongated portion and a connecting portion extending generally laterally forward of said elongated portion at a first end thereof, said elongated portion having a substantially constant width transverse to the direction of elongation thereof and said elongated portion being longer in the direction of elongation than said width, a first edge of said connecting portion remote from said elongated portion extending laterally of said elongated portion and being affixed to said lacing strip, said elongated portion extending generally downwardly and rearwardly from said connecting portion to a second end opposite from said first end, said second end being affixed to a rearward portion of said shoe, the dimension of said connecting portion in said direction of elongation of said elongated portion being greater at the juncture of said connecting portion with said elongated portion than the dimension of said connecting portion in such direction at the forwardmost tip of said connecting portion, wherein a second edge of said connecting portion extends from the forwardmost tip of said connecting portion to the juncture of said connecting portion with said elongated portion, and said second edge of said connecting portion is substantially straight and slopes away from said lacing strip to the juncture of said connecting portion with said elongated portion.

2. A shoe as claimed in claim 1, wherein a second edge of said connecting portion extends from the forwardmost tip of said connecting portion to the juncture of said connecting portion with said elongated portion, and said second edge of said connecting portion is substantially straight and slopes away from said lacing strip to the juncture of said connecting portion with said elongated portion.

3. A shoe as claimed in claim 1, further comprising an elongated auxiliary strap of relatively inextensible material extending from said lacing strip to said sole generally parallel to said elongated portion of said bandage, said auxiliary strap being positioned generally rearwardly of said bandage.

4. A shoe as claimed in claim 3, wherein said auxiliary strap is joined to said bandage at said connecting portion of said bandage and at the juncture of said elongated portion with said sole, and said auxiliary strap is formed integrally with said bandage.

5. A shoe as claimed in claim 3, wherein said elongated portion is wider than said auxiliary strap.

6. A shoe as claimed in claim 1, wherein the length of said first edge of said connecting portion is greater than the width of said elongated portion.

* * * * *

UNITED STATES PATENT AND TRADEMARK OFFICE

CERTIFICATE OF CORRECTION

PATENT NO. : 4,342,161

DATED : August 3, 1982

INVENTOR(S) : MICHAEL W. SCHMOHL

It is certified that error appears in the above-identified patent and that said Letters Patent are hereby corrected as shown below:

Column 6, line 10 for "shoe" read--sole--.

Signed and Sealed this

*Fifth* Day of *July 1983*

[SEAL]

*Attest:*

GERALD J. MOSSINGHOFF

*Attesting Officer*

*Commissioner of Patents and Trademarks*